United States Patent [19]

Berry et al.

[11] 4,099,399

[45] Jul. 11, 1978

[54] METHOD AND APPARATUS FOR PRODUCTION OF HOT-FORMED METALLIC ROD

[75] Inventors: Milton E. Berry; Daniel B. Cofer, both of Carrollton, Ga.

[73] Assignee: Southwire Company, Carrollton, Ga.

[21] Appl. No.: 806,965

[22] Filed: Jun. 16, 1977

Related U.S. Application Data

[63] Continuation of Ser. No. 614,126, Sep. 17, 1975, abandoned.

[51] Int. Cl.[2] ..... B21B 9/00; B21B 45/04

[52] U.S. Cl. ..... 72/38; 72/39; 72/40

[58] Field of Search ..... 29/81 A, 81 B, 81 C, 29/81 F, 81 H, 81 K; 72/38, 39, 43, 45, 201, 40, 236

[56] References Cited

U.S. PATENT DOCUMENTS

| | | | |
|---|---|---|---|
| 2,197,022 | 4/1940 | Petterson | 72/40 |
| 3,257,835 | 6/1966 | Cofer et al. | 72/38 |
| 3,498,094 | 3/1970 | Simon | 72/38 |
| 3,608,344 | 9/1971 | Schwan | 72/38 |
| 3,616,668 | 11/1971 | Smith | 72/236 |
| 3,780,552 | 12/1973 | Stasklewicz et al. | 72/40 |
| 3,806,366 | 4/1974 | Cofer et al. | 72/39 |
| 3,881,337 | 5/1975 | Cofer et al. | 72/45 |
| 4,043,166 | 8/1977 | Leroy | 72/39 |

*Primary Examiner*—E. M. Combs

*Attorney, Agent, or Firm*—Herbert M. Hanegan; Stanley L. Tate; Robert S. Linne

[57] ABSTRACT

Hot-formed rod is prepared in a rolling mill by removing oxide from the surface of a nascent cast bar while the bar is in a non-oxidizing environment. Oxide is removed from the surface of the bar by means such as wire brushing, for example, with the oxide removing means and the nascent bar being enclosed in a non-oxidizing or reducing environment to improve the removal of existing oxide and to inhibit formation of new oxide on the bar while the bar travels from the oxide-removing means to the rolling mill to be hot-formed. Removal of oxide while the bar is in a non-oxidizing environment enhances the removal of oxide and lessens the unwanted removal of metal underlying the surface oxide.

10 Claims, 5 Drawing Figures

METHOD AND APPARATUS FOR PRODUCTION OF HOT-FORMED METALLIC ROD

CROSS-REFERENCE TO RELATED APPLICATIONS

This application is a continuation of copending application Ser. No. 614,126 filed Sept. 17, 1975, now abandoned.

This invention relates in general to the production of a hot-formed metallic product, and in particular to improvements in the continuous production of hot-formed copper rod.

The manufacture of rod in a continuous casting system is an integrated process in which a newly-formed or nascent metallic bar is typically hot-formed into rod by being passed through a rolling mill soon after the bar emerges from the continuous casting machine, so that the newly-formed or nascent bar is hot-formed while still in a plastic state.

The surface of a nascent copper bar immediately oxidizes as soon as the bar surface is exposed to ambient atmosphere, and this surface oxidation should be removed before the bar is hot-formed by working the bar in a rolling mill. If oxidation is present on the surface of the bar when the bar is hot-formed in a rolling mill, particles of oxide from the surface will be rolled into the bar with the typical result that the strength, ductility, and conductivity of the resulting hot-formed rod is reduced by the presence of the oxide particles which were rolled into the bar during hot-forming.

It has been recognized in the art that copper bar preferably should be hot-formed while free of surface oxidation, and numerous attempts have been made to ensure that the surface of a copper bar is substantially free of oxidation when the bar enters the rolling mill to be hot-formed. One prior art proposel (Cofer et. al. U.S. Pat. No. 3,257,835) requires that the nascent bar be introduced into a non-oxidizing atmosphere as soon as the bar leaves the continuous casting machine, and be maintained in such atmosphere throughout the entire path which the nascent bar travels from the casting machine to the hot-forming rolling mill. The rolling mill itself may also be surrounded by a fluid-tight enclosure within which is maintained the non-oxidizing atmosphere, so that surface oxides cannot form on the bar at any time during passage of the bar through the rolling mill. It has proved difficult, as a practical matter, to maintain a non-oxidizing atmosphere along the entire route of bar travel from a continuous casting machine to a rolling mill, since the nascent bar may be exposed to ambient atmosphere at the point where the bar is removed from the casting wheel of a continuous casting machine and is thereafter cooled by a water spray to a sufficient extent that the bar has enough rigidity to be moved by conveying apparatus such as pinch rollers or the like. Moreover, a nascent bar which has just emerged from a continuous casting machine remains sufficiently plastic, due to the elevated temperature of the bar, that a fluid-tight enclosure may impede the progress of the bar and deform the bar from an intended straight-line path of travel. When this occurs, the resulting "cobbles" must be manually removed by cutting the cobble from the bar. The need to remove possible cobbles in the path of bar travel from the continuous casting machine to the rolling mill requires that this path be easily accessible, a requirement that is inconsistent with the need for a fluid-tight enclosure to maintain a non-oxidizing atmosphere in the path of bar travel from the continuous casting machine to the rolling mill.

As an alternative to preventing the formation of surface oxide on a nascent bar, it has been proposed to remove the surface oxide immediately before the bar enters the rolling mill for hot-forming. The surface oxide would be removed by mechanically abrading the surface of the nascent bar with means such as wire brushes or scrapers, as described in U.S. Pat. No. 3,331,123. While the aforementioned problems associated with the maintenance of a non-oxidizing environment from the continuous casting machine to the rolling mill are avoided by allowing surface oxidation to form and then subsequently removing the surface oxidiation immediately before introducing the nascent bar into the rolling mill, it has been found that the degree of mechanical abrasion necessary for complete removal of surface oxides also removes a layer of the unoxidized metal underlying the surface oxides. Such unwanted removal of unoxidized metal wastes energy in the abrasion process, and reduces the total cross-section bar area which is available for hot-forming into rod. Extreme variations in cross-section area would cause problems in the rolling schedule of the rolling mill.

It has also been proposed to prevent the formation of surface oxides on a nascent bar, and to remove surface oxide that has already formed on the bar, by maintaining the bar in a reducing gas environment prior to admitting the bar to a rolling mill. The problems discussed above with respect to maintaining the nascent bar in a non-oxidizing environment are generally encountered while attempting to maintain the bar in a reducing gas environment; moreover, it has proven difficult to obtain complete removal of existing surface oxides merely by passing the nascent bar through a reducing gas environment, while moving the nascent bar at a rate of travel consistent with the capabilities of continuous casting machines and rolling mills.

According to the present invention, it has been discovered that the need for maintaining the nascent bar in a restricted fluid environment during the entire path of travel from the continuous casting machine to the rolling mill is eliminated, and the problems associated with mechanical removal of surface oxides are reduced or eliminated by mechanically removing surface oxides from the bar while the bar is maintained in a non-oxidizing or reducing fluid environment, and thereafter maintaining the de-oxidized bar in a non-oxidizing or reducing fluid environment at least until the bar is introduced to the rolling mill for hot-forming.

Accordingly, it is an object of the present invention to provide an improved method and apparatus for removing surface oxidation from a nascent metallic bar.

It is another object of the present invention to provide an improved method and apparatus for preparing a nascent metallic bar for hot-forming.

It is still another object of the present invention to provide a method and apparatus for preparing a nascent copper bar for hot-forming.

It is a further object of the present invention to provide an improved metallic rod.

It is yet another object of the present invention to provide improved apparatus for manufacturing hot-formed metallic rod.

Other objects and advantages of the present invention will become more readily apparent from the following discussion of the disclosed embodiments, as shown in the drawing in which.

Figure 1:
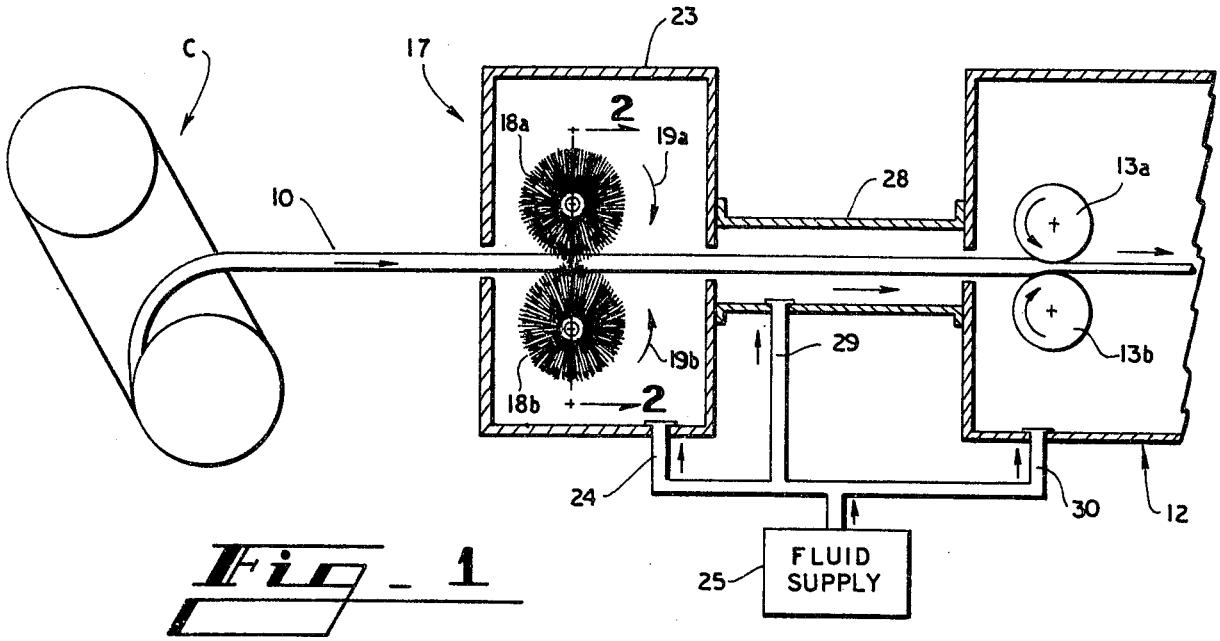
FIG. 1 shows a schematic view of a first disclosed embodiment of the present invention.

Turning to the disclosed embodiment depicted in FIG. 1, there is shown a nascent bar 10 which has just been removed from a continuous casting machine C and is traveling along a path indicated by the arrow 11 toward the rolling mill 12 for hot-forming therein. Structured and operational details of continuous casting machines and of rolling mills for hot-forming a cast rod are known to those skilled in the art and need not be set forth herein, although it will be understood that such rolling mills generally have a series of opposed spaced-apart sets of powered rolls, exemplified by the depicted 13*a* and 13*b*, through which the bar 10 serially travels to be progressively worked and shaped by the rolls.

Figure 2:
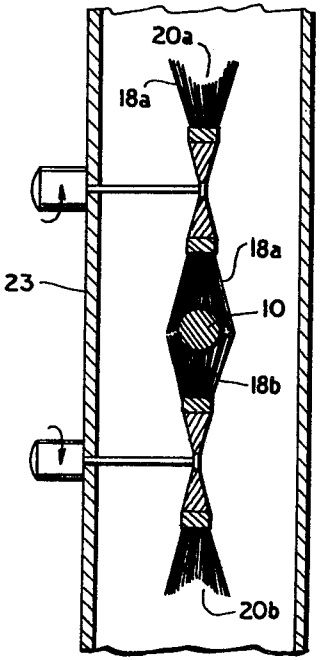
FIG. 2 shows a section view taken along line 2—2 of FIG. 1, showing cross-section detail of the rotary brushes.

Prior to entering the rolling mill 12, the nascent bar 10 enters the oxide removal station indicated generally at 17 and containing a means for mechanically removing oxide formations from the surface of the nascent bar. The oxide removal means, in the embodiment shown in FIG. 1, comprises the radial brushes 18*a* and 18*b* diametrically opposed on opposite sides of the bar surface. The brushes 18*a* and 18*b* are power-driven in the counter-rotating directions indicated by the arrows 19*a* and 19*b* so that the brushes contact the bar surface in directions opposite to the direction of bar travel. The brushes 18*a* and 18*b* typically are wire brushes which may have surfaces contour to fit the bar 10 at the point of contact, as more specifically shown at the contoured brush peripheries 20*a* and 20*b* in FIG. 2. It will be understood that the number of individual brushes, shown as two brushes in the disclosed embodiment of FIG. 1, is dependent upon the surface contour of the nascent bar 10, and that more than two brushes may be required for complete brushing contact with the surface of a bar having a non-circular cross-section. By way of example, a cast bar from a continuous casting machine may have a cross-section generally in the shape of a triangle, and three separate brushes may be required for adequate surface contact of such bar in the manner shown in the aforementioned U.S. Pat. No. 3,331,123.

The oxide removal station 17 includes a generally fluid-tight enclosure 23 which completely surrounds and encloses the brushes 18*a*, 18*b* (or other oxide removing means), and the enclosure 23 is connected by a conduit 24 to a fluid supply 25. The fluid supply 25 supplies a suitable non-oxidizing or reducing fluid to the enclosure 23, so that mechanical removal of oxide from the bar 10 within the enclosure takes place in an atmosphere which is non-oxidizing, at the least, and which may be a reducing atmosphere through appropriate selection of fluid from the fluid supply 25. The result is that oxide is mechanically removed from the surface of the nascent bar 10 while the nascent bar is in a non-oxidizing or reducing fluid environment, and it appears that mechanical removal of surface oxide while in the non-oxidizing or reducing atmosphere causes less mechanical damage to the bar (such as unwanted removal of metal underlying the oxidized surface) and less microporosity than has been previously obtained in oxide removal using techniques of the prior art.

It is necessary to maintain the de-oxidized bar 10 in a non-oxidizing or reducing fluid environment while the bar travels from the oxide removal station 17 to the rolling mill 12, so that oxidation does not reoccur on the surface of the bar. The bar 10, accordingly, passes through an enclosure 28 which extends along the entire path of travel of the bar from the oxide removal station 17 to the rolling mill 12. The enclosure 28 is provided with a non-oxidizing or reducing fluid environment by way of the conduit 29, which may be connected to the fluid supply 25 to receive the same non-oxidizing or reducing fluid which is supplied to the oxide removal station 17.

Since the bar 10 may also be maintained in a non-oxidizing or reducing atmosphere within the rolling mill 12, a conduit 30 may be provided from the rolling mill to the supply of fluid 25 so that the rolling mill receives the same non-oxidizing or reducing fluid that is supplied to the oxide removal station 17 and to the bar enclosure 28.

The nature of the non-oxidizing or reducing fluid admitted to the oxide removal station 17 is not considered to be critical, provided that the oxygen content of the fluid is insufficient to cause oxidation of the nascent bar surface. Suitable reducing fluids can contain one or more of such known reducing gases as hydrogen, carbon monoxide, or the like.

Figure 3:
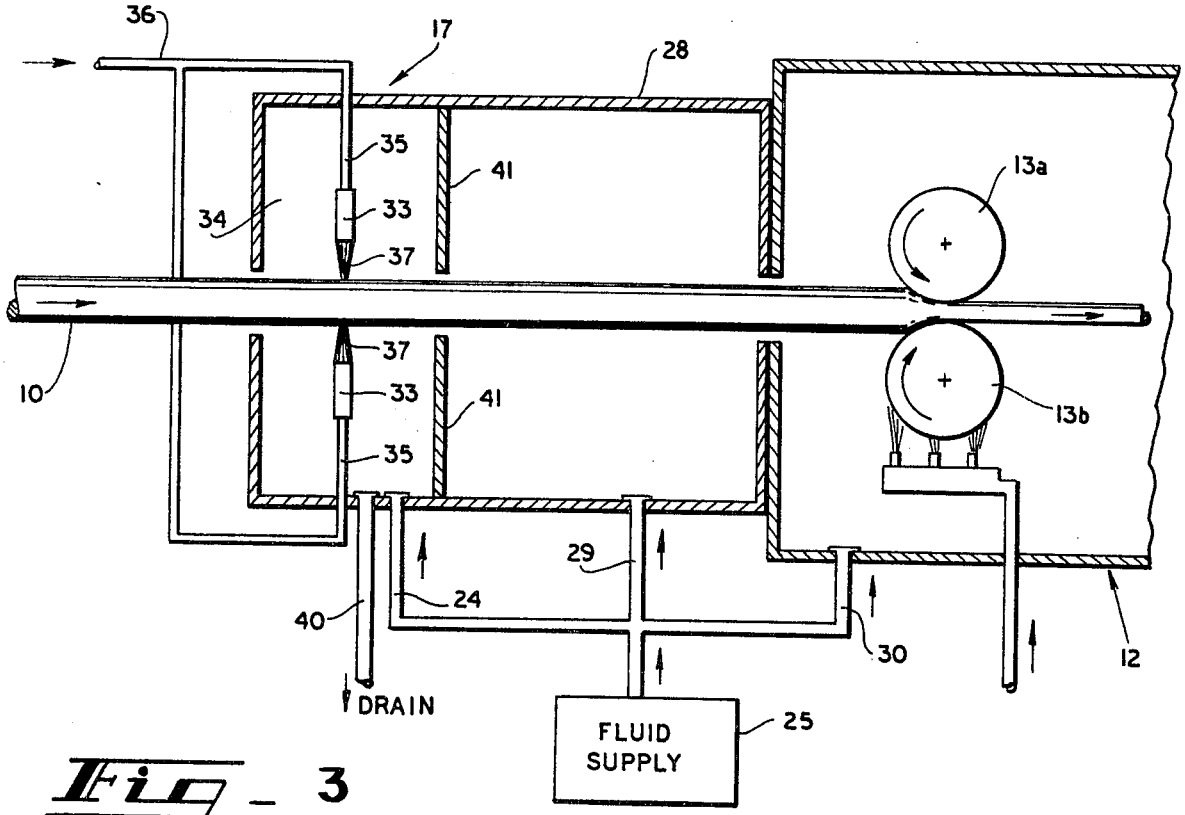
FIG. 3 shows a schematic view of another disclosed embodiment of the present invention.

The alternative embodiment shown in FIG. 3 removes oxide from the surface of the bar by utilizing the forces created by impinging high-pressure jets of liquid against the surface of the nascent bar 10 in the oxide removal station 17, in place of the rotary brushes used in the embodiment of FIG. 1, while the bar is in a non-oxidizing environment. The high-pressure liquid jets are provided by a plurality of nozzles 33, which are contained within the chamber 34 of the oxide removal station 17 and which form a nozzle array surrounding the bar 10 passing through the chamber 34. Each of the nozzles 33 is connected by a suitable conduit 35 to receive a source of high-pressure liquid supplied through the line 36. The liquid supplied through the line 36 to the nozzles 33 may be water or a water-based liquid containing a reducing material such as alcohol or the like. Although the nozzles 33 are shown in FIG. 3 as directing the rate 37 substantially perpendicular to the nascent bar 10, it will be understood that the angle of contact of the descaling jets can be adjusted to any other angle necessary to optimize removal of surface oxide by the impact of the liquid jets against the surface of the bar.

A drain line 40 communicates with the chamber 34 to remove the liquid which is emitted from the nozzles 33, along with scale or ozide which has been removed from the rod by the impinging liquid jets. The chamber 34 is separated from the enclosure 28 by way of wall 41, and both the chamber 34 and the enclosure 28 are supplied with a suitable non-oxidizing or reducing fluid, preferably gaseous, from the fluid supply 25 in the manner described above with respect to the embodiment shown in FIG. 1. It will be appreciated that the chamber 34 must receive a sufficient supply of fluid from the fluid supply 25 to maintain a slightly super-atmospheric pressure within the chamber, so that no substantial amount of oxygen-containing ambient atmosphere can enter the chamber 34 through openings such as the drain 40 or the passages through which the bar enters and exits the enclosure 23. The rolling mill 12 is also connected to receive fluid from the fluid supply 25, as described hereinabove, so that the nascent bar 10 is maintained in a non-oxidizing or reducing fluid environment during hot-forming through rolling as well as when surface oxide is removed by liquid-jet impingement at the oxide removal station 17.

Figure 4:
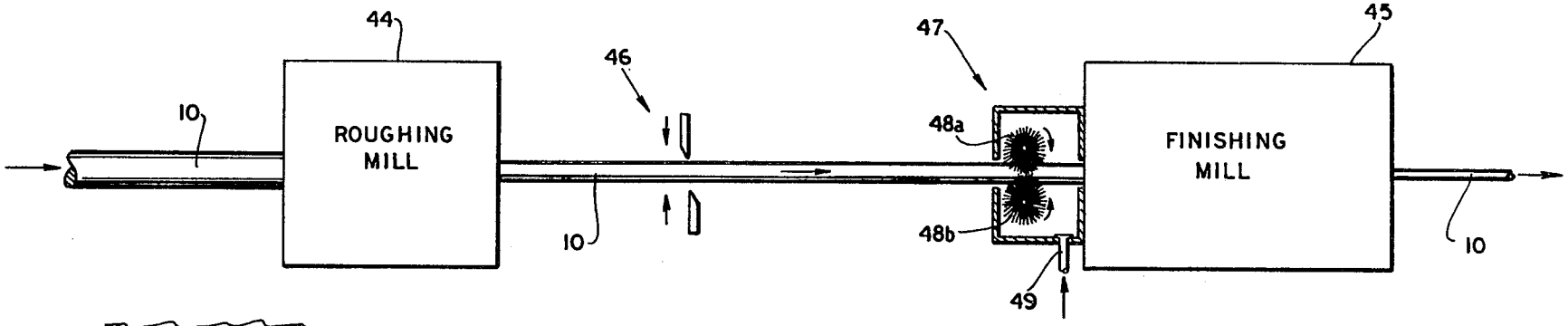
FIG. 4 shows a schematic view of an alternative application of the embodiment shown in FIG. 1.

Although the present invention is described thus far in terms of removing surface oxides or scale from a nascent bar shortly after the bar is removed from a continuous casting machine and before any hot-forming or other working of the bar has occurred, the embodiment depicted in FIG. 4 shows that alternative applications of the present invention can be made. For example, hot-forming of a cast bar is sometimes accomplished in a two-stage rolling process in which initial rolling takes place in a so-called roughing mill 44 and the remaining rolling takes place in a finishing mill 45. A shear apparatus shown diagrammatically at 46 may be positioned adjacent the path which the bar 10 travels between the roughing mill 44 and the finishing mill 45, so that the bar 10 can be sheared into discrete sections if desired. The physical size of the shear 46 makes it impractical to enclose the entire path over which the bar travels between the roughing mill and the finishing mill, and so the surface of the still-hot bar becomes oxidized during the time the bar is traveling between these two rolling mills.

Accordingly, it becomes desirable to provide an oxide removal station 47 through which the bar passes immediately before entering the finishing mill 45. The oxide removal station 47 is similar to the station 17 shown in the embodiment of FIG. 1 and contains a pair of rotating brushes 48*a*, 48*b* which are power-driven to rotate in directions opposed to movement of the bar toward the finishing mill 45. The oxide removal station is supplied with a suitable non-oxidizing or reducing fluid through the conduit 49, and it will be understood that the finishing mill 45 can also be provided with a non-oxidizing or reducing fluid environment.

Figure 5:
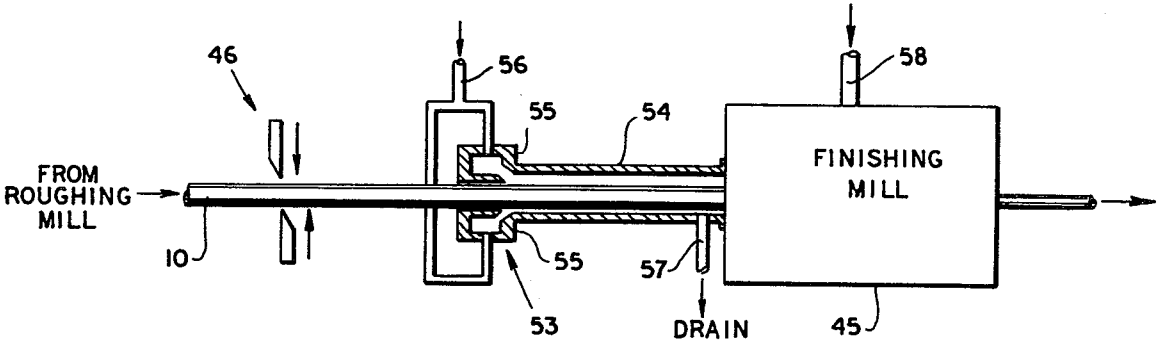
FIG. 5 shows a schematic view of yet another disclosed embodiment of the present invention.

FIG. 5 shows an alternative embodiment of apparatus according to the present invention which can be used to remove oxidation which has formed between the roughing mill and a finishing mill. Oxidation is removed from the rod 10 by subjecting the rod to a suitable pickling fluid, in the embodiment shown in FIG. 5, as the rod passes through an oxide removal station 53 including a pickling pipe 54 which extends from the finishing mill 45 backwards along the path of rod travel to terminate at a pickling fluid injector 55. A suitable pickling fluid is supplied to the fluid injector 55 through the line 56, so that the rod 10 is surrounded with pickling fluid within the injector and along substantially the entire extent of the pickling tube 54. The pickling fluid may be removed from the pickling tube 54 by way of the drain conduit 57. Suitable pickling fluids, as known to those skilled in the art, are acidic compounds, such as sulphuric acid, and non-acidic compounds such as certain alcohols.

The finishing mill 45 may be supplied with reducing gas through the conduit 58, if desired, to maintain a non-oxidizing or reducing fluid environment within the finishing mill.

Although wire brushes and certain other specific apparatus is shown in the disclosed embodiments for removal of oxide from the rod surface, it should be understood that other oxide removing means may be substituted in the practice of the present invention so long as the oxide remaining means accomplishes removal of oxide while in a non-oxidizing atmosphere.

It will be understood that the foregoing relates only to preferred embodiments of the present invention, and that numerous changes and modifications may be made therein without departing from the spirit and the scope of the invention as set forth in the following claims.

What is claimed is:

1. The improved method of hot-forming a metallic cast bar of the type wherein a continuous length of bar is conveyed from a casting machine to a hot-rolling mill along a path which exposes said bar to an oxidizing atmosphere thereby forming metallic oxides on the exposed surface of said bar and wherein said bar is mechanically cleaned prior to entry into said rolling mill, the improvement comprising the steps of:

mechanically removing oxide from the surface of the bar while in a chemically reducing environment for limiting the amount of metal mechanically removed from the surface of the bar, thus minimizing mechanical damage and microporosity of the bar; and then maintaining the de-oxidized bar in a reducing environment at least until the bar is introduced into a rolling mill.

2. The method as in claim 1, wherein said removal of oxide is accomplished by brushing the surface of the bar while in said reducing environment.

3. The method as in claim 1, wherein said removal of oxide is accomplished by impinging a fluid stream against the oxidized surface of the bar with sufficient force to physically remove oxide from the bar surface, while in said reducing environment.

4. The method as in claim 1, comprising the further step of maintaining a reducing environment in the rolling mill while the de-oxidized bar is being rolled therein.

5. Improved apparatus for hot-forming a metallic bar which becomes exposed to an oxidizing atmosphere while traveling along a path towards a rolling mill, of the type comprising: a rolling mill for roll-forming a hot metallic bar into rod; and means for mechanically removing oxide from the surface of the bar traveling to said rolling mill;

wherein the improvement comprises means for enveloping said oxide removing means in a chemically non-oxidizing atmosphere for limiting the amount of metal mechanically removed from the surface of the bar, thus minimizing mechanical damage and microporosity of the bar and surrounding the path of bar travel from said oxide removing means to said rolling mill.

6. Apparatus as in claim 5, further comprising means maintaining the rolling mill in a non-oxidizing atmosphere.

7. Apparatus as in claim 5, wherein said oxide removing means comprises means for mechanically contacting and removing oxide from the bar surface by brushing.

8. Apparatus as in claim 5, wherein:

said oxide removing means comprises fluid jet means operative to impinge a stream of fluid against the surface of the bar with force sufficient to physically remove oxide from the bar surface.

9. Apparatus as in claim 5, wherein:

said oxide removing means comprises brush means operative to remove oxide from the surface of the bar; and said means for maintaining non-oxidizing atmosphere comprises enclosure means surrounding said brush means and including an inlet aperture through which the bar travels to be contacted by said brush means; and a source of non-oxidizing fluid connected to said enclosure means.

10. Apparatus as in claim 9, wherein said source of non-oxidizing fluid comprises a source of reducing gas.

* * * * *